US007675486B2

(12) United States Patent
Takai

(10) Patent No.: US 7,675,486 B2
(45) Date of Patent: Mar. 9, 2010

(54) DRIVE SYSTEM OF DISPLAY DEVICE

(75) Inventor: Kazumasa Takai, Kakamigahara (JP)

(73) Assignee: SANYO Electric Co., Ltd., Osaka (JP)

( * ) Notice: Subject to any disclaimer, the term of this patent is extended or adjusted under 35 U.S.C. 154(b) by 1497 days.

(21) Appl. No.: 10/998,154

(22) Filed: Nov. 29, 2004

(65) Prior Publication Data

US 2005/0140608 A1 Jun. 30, 2005

(30) Foreign Application Priority Data

Nov. 28, 2003 (JP) ..... 2003-399941

(51) Int. Cl.
*G09G 3/30* (2006.01)

(52) U.S. Cl. ..... 345/76; 345/93; 345/204; 345/212; 345/213; 345/214

(58) Field of Classification Search ..... 345/76–104, 345/204–215, 690–699
See application file for complete search history.

(56) References Cited

U.S. PATENT DOCUMENTS 7,256,756 B2 * 8/2007 Abe ..... 345/76
7,259,740 B2 * 8/2007 Haga et al. ..... 345/98
2003/0048669 A1 * 3/2003 Abe ..... 365/189.09
2003/0067434 A1 * 4/2003 Haga et al. ..... 345/98
2003/0132907 A1 * 7/2003 Lee et al. ..... 345/98
2003/0179164 A1 * 9/2003 Shin et al. ..... 345/76

FOREIGN PATENT DOCUMENTS

JP 2003-150118 A 5/2003

* cited by examiner

*Primary Examiner*—Vijay Shankar
(74) *Attorney, Agent, or Firm*—Morrison & Foerster LLP

(57) ABSTRACT

This invention provides a drive system of a display device preventing an uneven display caused by output current values of current conversion circuits. A drive system of a display device of the invention has a plurality of pixels disposed in a matrix of m rows and n columns and having current drive elements, n pieces of current conversion circuits converting digital display signals inputted from outside into analog signals corresponding to the digital display signals, a first selector circuit selectively supplying the digital display signals to the n pieces of the current conversion circuits, and a second selector circuit selectively supplying current outputs of n pieces of the current conversion circuits to pixel groups divided in columns.

10 Claims, 4 Drawing Sheets

FIG.2 column → row ↓

Field (n)

| | | | | | | | | |
|---|---|---|---|---|---|---|---|---|
| 1 | 2 | 3 | 4 | 5 | 6 | 7 | ··· | n |
| 7 | n | 1 | 2 | 3 | 4 | 5 | ··· | 6 |
| 5 | 6 | 7 | n | 1 | 2 | 3 | ··· | 4 |
| 3 | 4 | 5 | 6 | 7 | n | 1 | ··· | 2 |
| 1 | 2 | 3 | 4 | 5 | 6 | 7 | ··· | n |
| 7 | n | 1 | 2 | 3 | 4 | 5 | ··· | 6 |
| 5 | 6 | 7 | n | 1 | 2 | 3 | ··· | 4 |
| 3 | 4 | 5 | 6 | 7 | n | 1 | ··· | 2 |
| 1 | 2 | 3 | 4 | 5 | 6 | 7 | ··· | n |
| 7 | n | 1 | 2 | 3 | 4 | 5 | ··· | 6 |
| 5 | 6 | 7 | n | 1 | 2 | 3 | ··· | 4 |
| 3 | 4 | 5 | 6 | 7 | n | 1 | ··· | 2 |

Field (n+1)

| | | | | | | | | |
|---|---|---|---|---|---|---|---|---|
| 5 | 6 | 7 | n | 1 | 2 | 3 | ··· | 4 |
| 3 | 4 | 5 | 6 | 7 | n | 1 | ··· | 2 |
| 1 | 2 | 3 | 4 | 5 | 6 | 7 | ··· | n |
| 7 | n | 1 | 2 | 3 | 4 | 5 | ··· | 6 |
| 5 | 6 | 7 | n | 1 | 2 | 3 | ··· | 4 |
| 3 | 4 | 5 | 6 | 7 | n | 1 | ··· | 2 |
| 1 | 2 | 3 | 4 | 5 | 6 | 7 | ··· | n |
| 7 | n | 1 | 2 | 3 | 4 | 5 | ··· | 6 |
| 5 | 6 | 7 | n | 1 | 2 | 3 | ··· | 4 |
| 3 | 4 | 5 | 6 | 7 | n | 1 | ··· | 2 |
| 1 | 2 | 3 | 4 | 5 | 6 | 7 | ··· | n |
| 7 | n | 1 | 2 | 3 | 4 | 5 | ··· | 6 |

Field (n+2)

| | | | | | | | | |
|---|---|---|---|---|---|---|---|---|
| 1 | 2 | 3 | 4 | 5 | 6 | 7 | ··· | n |
| 7 | n | 1 | 2 | 3 | 4 | 5 | ··· | 6 |
| 5 | 6 | 7 | n | 1 | 2 | 3 | ··· | 4 |
| 3 | 4 | 5 | 6 | 7 | n | 1 | ··· | 2 |
| 1 | 2 | 3 | 4 | 5 | 6 | 7 | ··· | n |
| 7 | n | 1 | 2 | 3 | 4 | 5 | ··· | 6 |
| 5 | 6 | 7 | n | 1 | 2 | 3 | ··· | 4 |
| 3 | 4 | 5 | 6 | 7 | n | 1 | ··· | 2 |
| 1 | 2 | 3 | 4 | 5 | 6 | 7 | ··· | n |
| 7 | n | 1 | 2 | 3 | 4 | 5 | ··· | 6 |
| 5 | 6 | 7 | n | 1 | 2 | 3 | ··· | 4 |
| 3 | 4 | 5 | 6 | 7 | n | 1 | ··· | 2 |

DRIVE SYSTEM OF DISPLAY DEVICE

CROSS-REFERENCE OF THE INVENTION

This invention is based on Japanese Patent Application No. 2003-399941, the content of which is incorporated by reference in its entirety.

BACKGROUND OF THE INVENTION

1. Field of the Invention

This invention relates to a drive system of a display device, particularly to such a system having a drive circuit using a current programming method.

2. Description of the Related Art

In recent years, organic electroluminescent (hereafter, referred to as EL) display device using organic EL elements have been receiving attention as a display device substituting for a CRT or an LCD. Particularly, an active matrix type organic EL display device having thin film transistors as switching elements for driving the organic EL elements has been developed. Different from LCDs, such organic EL elements are self-light-emitting elements providing luminance corresponding to a current flowing in the EL elements.

There are various types of drive systems for such an organic EL display device, and one of these is a current programming method. In this method, for obtaining luminance corresponding to a digital display signal, by utilizing such current and luminance correspondence characteristics of the organic EL element described above, a current value corresponding to the digital display signal is set by a current conversion circuit (also called a current DAC) and the current is supplied from the current conversion circuit to each of the pixels.

Particularly, in a high-precision organic EL display device, a plurality of the current conversion circuits are provided for each of pixel groups divided in columns in order to secure time for programming the current to the pixel. Such a drive system is called a multi-channel current DAC method since a channel is provided in each of the pixel groups divided in columns.

FIG. 4 is a block diagram showing a drive system of an organic EL display device of a conventional art. A plurality of pixels P11, P12 . . . each having an organic EL element is disposed in a matrix of m rows and n columns. The n pieces of current conversion circuits DAC1 to DACn are disposed for the pixel groups divided in columns, respectively. These current conversion circuits DAC1 to DACn convert digital display signals D1 to Dn inputted therein into currents I1 to In having current values corresponding to the signals D1 to Dn, respectively, and supplies the currents I1 to In to the pixel groups divided in columns, respectively.

For example, during the first horizontal scanning period, the currents I1, I2, . . . and In are supplied to the pixels P11, P12, . . . and P1*n*, in this order. Then, during the next horizontal scanning period, the currents I1, I2, . . . and In are supplied to the pixels P21, P22, . . . and P2*n*, in this order, respectively. Such a horizontal scanning is repeated to the whole remaining lines, thereby completing one field scanning period.

FIG. 5 is a table showing a correspondence relationship between the pixel groups divided in columns and the current conversion circuits DAC1 to DACn for driving these pixel groups in this drive system of the organic EL display device. As seen in FIG. 5, the pixels in each of the pixel groups divided in columns are driven by the same current conversion circuit. For example, in an n-th field, the pixels of the pixel group in the first column are driven by the current conversion circuit DAC1 indicated by "1" in FIG. 5, and the pixels of the pixel group in the second column are driven by the current conversion circuit DAC2 indicated by "2" in FIG. 5. The correspondence relationship is the same in an n+1 field and an n+2 field. The relating technology is disclosed in the Japanese Patent Application Publication No. 2003-150118.

Generally, n pieces of the current conversion circuits DAC1 to DACn are formed of LSIs, and there occurs variation in output current values of n pieces of the current conversion circuits DAC1 to DACn due to manufacture variations. This variation in the output current directly causes variations in luminance of the organic EL elements as current drive elements.

In the drive system of the display device of the conventional art shown in FIG. 4, the pixels of the pixel group in each of the columns are driven by the same current conversion circuit all the time. Therefore, when the value of the output current of the current conversion circuit provided for a certain column is unusually too high or too low compared with others, an uneven display with bright and dark parts appears in the line corresponding to the pixel group in that column.

Generally, human eyes can not recognize such an uneven display if variation of luminance is 1% or less, but it is difficult to keep the variation at 1% or less by current LSI manufacturing technologies.

SUMMARY OF THE INVENTION

The invention provides a drive system of a display device that includes a plurality of pixels provided in a matrix form comprising rows and columns. The pixels have corresponding current drive elements. The system also includes a plurality of current conversion circuits converting digital display signals that the drive system receives into analog currents corresponding to the digital display signals. The number of the current conversion circuits is equal to the number of the columns. The system further includes a first selector circuit supplying the digital display signals to the respective current conversion circuits, and a second selector circuit receiving outputs of the current conversion circuits and supplying the outputted to the respective pixels.

The invention also provides a drive system of a display device that includes a plurality of pixels provided in a matrix form comprising rows and columns. The pixels have corresponding current drive elements. The system also includes a current conversion circuit converting a digital display signal that the drive system receives into an analog current corresponding to the digital display signal. This current conversion circuit is provided for each of the columns. The system further includes a first selector circuit receiving the digital display signals that are directed to corresponding columns and routing the received digital display signals to current conversion circuits corresponding to columns that are not the destinations of the digital display signals, and a second selector circuit receiving the analog currents of the current conversion circuits and rerouting the analog currents to the columns that are the destinations of the digital display signals.

BRIEF DESCRIPTION OF THE DRAWINGS

FIG. 2 is a table showing one example of a correspondence relationship between pixel groups divided in columns and current conversion circuits DAC 1 to DACn for driving the pixel groups in the drive system of the organic EL display device of FIG. 1.

DETAILED DESCRIPTION OF THE INVENTION

Figure 1:
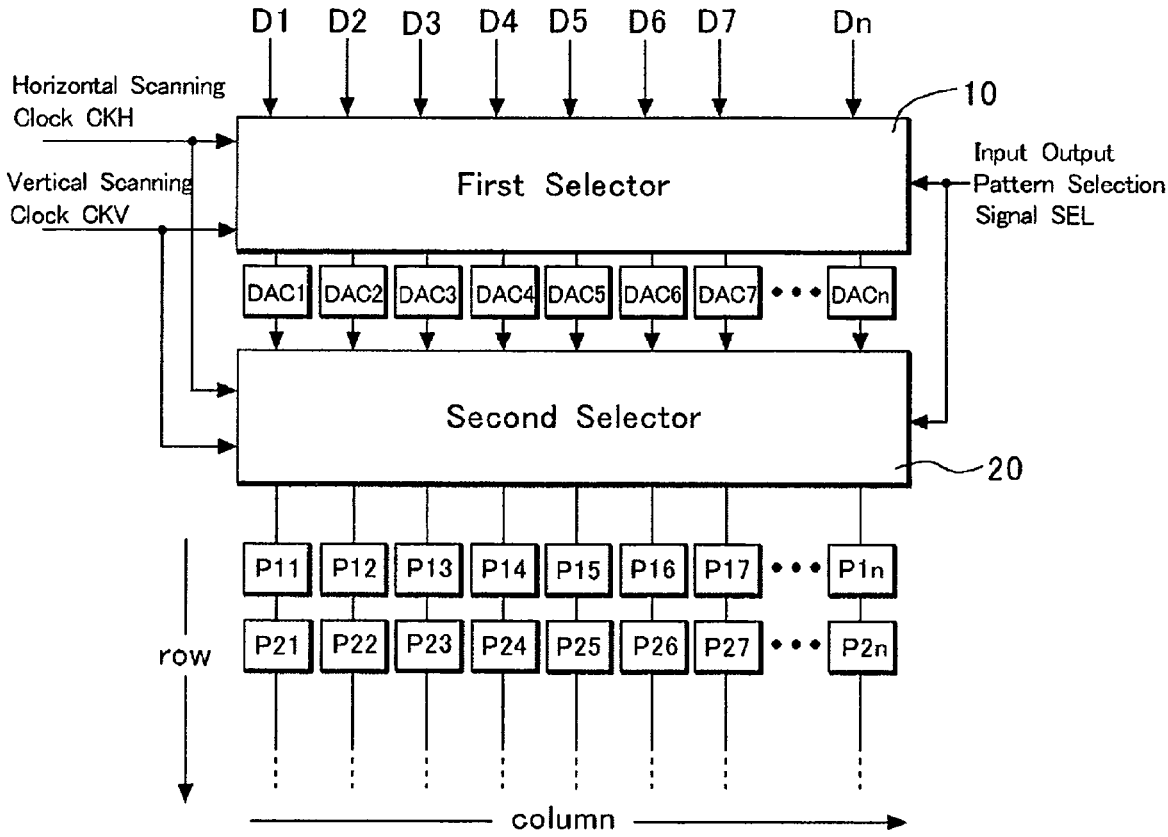
FIG. 1 is a block diagram showing a drive system of an organic EL display device of an embodiment of the invention.
Figure 3:
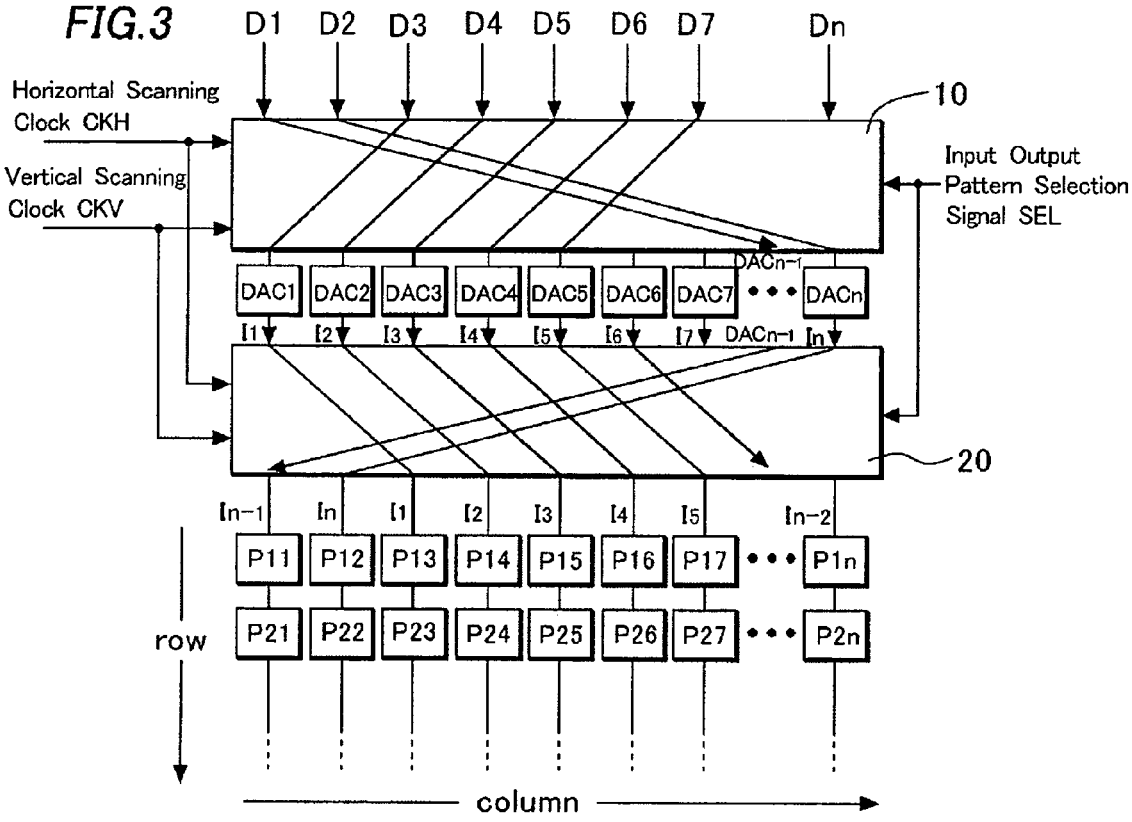
FIG. 3 is a diagram showing one example of a changed state of first and second selector circuits in the drive system of the organic EL display device of the embodiment of the invention.
Figure 4:
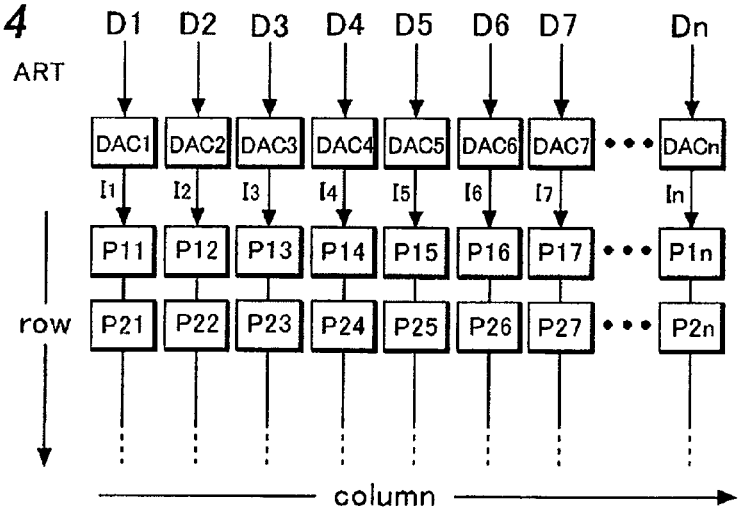
FIG.4 PRIOR ART
FIG. 4 is a block diagram showing a drive system of an organic EL display device of a conventional art.
Figure 5:
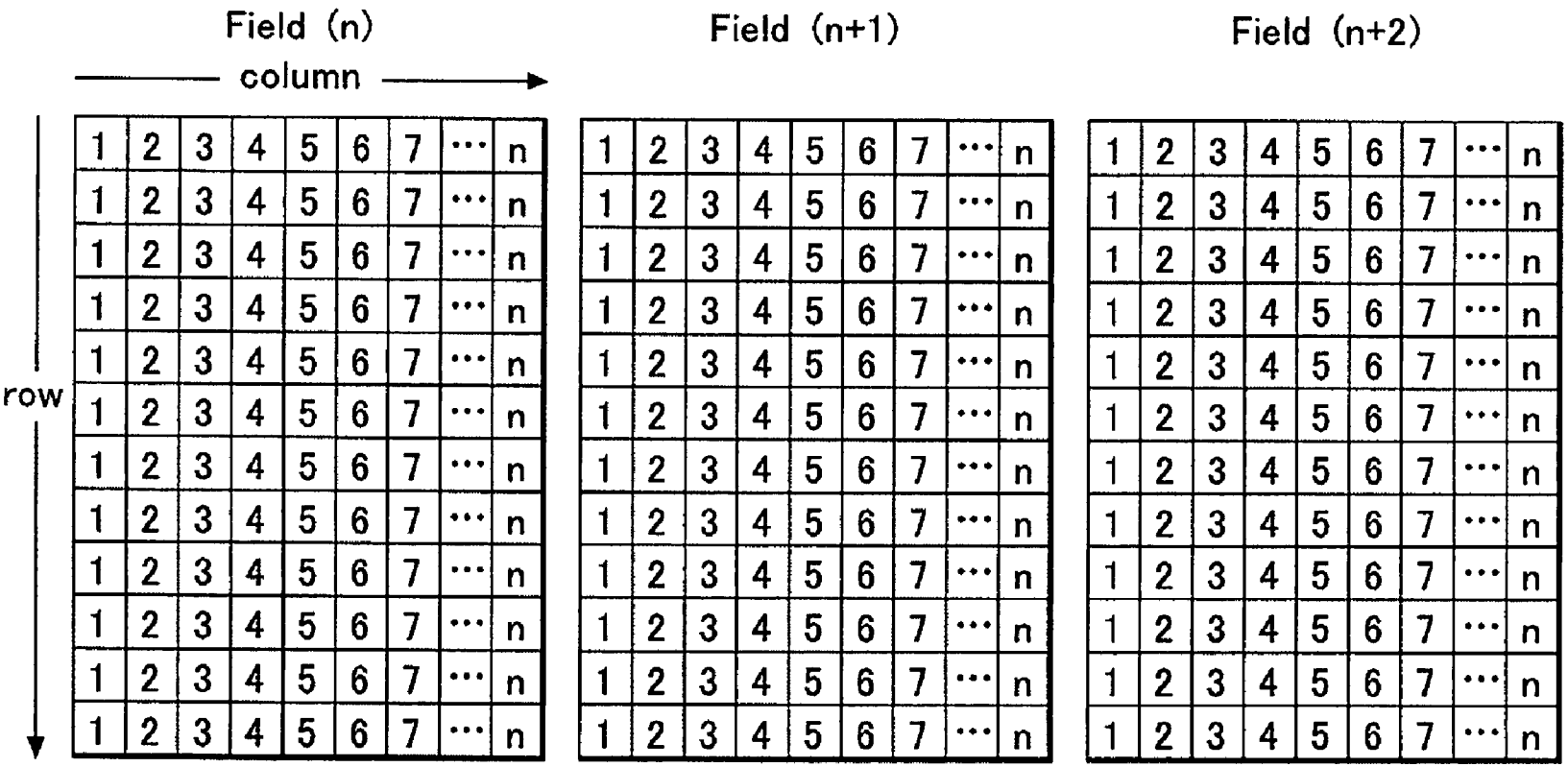
FIG.5 PRIOR ART
FIG. 5 is a table showing a correspondence relationship between pixel groups divided in columns and current conversion circuits DAC1 to DACn for driving the pixel groups in the drive system of the organic EL display device of FIG. 4.

An embodiment of the invention will be described with reference to FIGS. 1-3. FIG. 1 is a block diagram showing a drive system of an organic EL display device of this embodiment.

A plurality of pixels P11, P12, . . . each having an organic EL element is disposed in a matrix of m rows and n columns. The n pieces of current conversion circuits DAC1 to DACn are provided. These current conversion circuits DAC1 to DACn convert digital display signals D1 to Dn inputted through a first selector circuit 10 into currents I1 to In having current values corresponding to the digital signals D1 to Dn, respectively. The first selector circuit 10 is controlled by a horizontal scanning clock CKH, a vertical scanning clock CKV and an input/output pattern selection signal SEL to select which one among the current conversion circuits DAC1 to DACn is to be inputted with each of the digital display signals D1 to Dn in each of horizontal scanning periods or field periods.

Each of the currents I1 to In outputted from the current conversion circuits DAC1 to DACn is supplied to each of pixel groups divided in columns, which is selected through a second selector circuit 20. Among the pixel groups divided in columns, the pixel group in the first column is the pixel group (P11, P21, P31 . . . , Pm1), the pixel group in the second column is the pixel group (P12, P22, P32 . . . , Pm2), and the pixel group in the n-th column is the pixel group (P1*n*, P2*n*, P3*n* . . . , Pmn). The second selector circuit 20 is controlled by the horizontal scanning clock CKH, the vertical scanning clock CKV and the input/output pattern selection signal SEL to select which one among the pixel groups is to be supplied with each of the currents I1 to In outputted from the current conversion circuits DAC1 to DACn in each of horizontal scanning periods or field periods.

To specifically describe a changing operation when inputting the signals to and outputting the currents from the current conversion circuits DAC1 to DACn, it is preferable that the first and second selector circuits 10 and 20 use alternatively the current conversion circuits DAC1 to DACn to be inputted with the digital display signals D1 to Dn so as to change the pixel groups divided in columns to be supplied with the currents outputted from the current conversion circuits DAC1 to DACn, respectively, in each of the horizontal scanning periods, so as to avoid keeping the currents I1 to In being supplied to the same pixel group all the time during the one field period. Furthermore, it is preferable that the first and second selector circuits 10 and 20 use alternatively the current conversion circuits DAC1 to DACn to be inputted with the digital display signals D1 to Dn so as to change the pixel groups divided in columns to be supplied with the currents outputted from the current conversion circuits DAC1 to DACn in a manner different between two filed period, as shown in FIG. 2.

FIG. 2 is a diagram showing an example of a correspondence relationship between the pixel groups divided in columns and the current conversion circuits DAC1 to DACn for driving these pixel groups in the drive system of the organic EL display device. FIG. 2 shows pixels disposed in m rows and n columns, and the numbers in the matrix correspond to the current conversion circuits (DAC1-DACn), which supply currents to the corresponding pixels. For example, the pixel P11 in the first row and column is supplied with a current from the current conversion circuit DAC1, and the pixel P12 in the first row and the second column is supplied with a current from the current conversion circuit DAC2.

In this example, the relationship between the pixels and the current conversion circuits DAC1 to DACn is shifted by 2 channels in each of the horizontal scanning periods. For example, in the n-th field (n), in the line scanning of the first row, the current conversion circuits DAC1 to DACn are applied in order of 1, 2, 3, 4, . . . n.

In the line scanning of the second row, the application of the current conversion circuits DAC1 to DACn to the pixels is shifted by 2 channels. That is, the current conversion circuit DAC1 supplies a current to the pixel P23 in the second row and the third column instead of the pixel P21 in the second row and the first column. Similarly, the current conversion circuit DAC2 supplies a current to the pixel P24 in the second row and the fourth column. FIG. 3 is a diagram showing a changed state by the first and second selector circuits 10 and 20 in the line scanning of the second row. The current conversion circuit DAC1 is inputted with a digital display signal D3, converts this in a current, and supplies the current to the pixel P23 of the second row and the third column. The current conversion circuit DAC2 is inputted with a digital display signal D4, converts this into a current, and supplies the current to the pixel P24 of the second row and the fourth column.

As a result, the current corresponding to the digital display signal D1 is supplied to the pixel group of the first column, the current corresponding to the digital display signal D2 is supplied to the pixel group of the second column, and the current corresponding to the digital display signal D3 is supplied to the pixel group of the third column, and so on, as is the case with the conventional device. However, the current conversion circuits for converting the digital display signal into a current are alternated among the horizontal scannings of one field period as well as among individual field periods.

In the third line, the application of the current conversion circuits DAC1 to DACn to the pixels is shifted by 2 more channels. Like this manner, the application of the current conversion circuits DAC1 to DACn to the pixels is rotated by 2 channels in each of the horizontal scanning periods, but this rotation can stop on the midway to return to the same relationship of the application as in the first row. In this example, in the line scanning of the fifth row, the relationship of the application is returned to the same relationship as in the first row. It is noted that returning to the same relationship as in the first row is made in the fifth row for simplifying the description in this embodiment, but the rotation can be continued without resorting back to the original alignment.

Then, the scanning of the field (n) is completed, and in the next n+1 th field, the line scanning of the first row is started from the alignment where the relationship of the current conversion circuits DAC1 to DACn and the pixels is shifted by 4 channels. That is, in the line of the first row, the current conversion circuit DAC1 supplies a current to the pixel P15 of the first row and the fifth column. Similarly, the current conversion circuit DAC2 supplies a current to the pixel P16 of the first row and the sixth column. Then, in the line scanning of the second row, the application of the current conversion circuits DAC1 to DACn to the pixels is shifted by 2 channels, like the manner in the previous field (n). For example, the current conversion circuit DAC1 supplies a current to the pixel P27 of the second row and the seventh column.

Accordingly, by changing correspondence relationships at the first and second selector circuits 10 and 20 in each of the horizontal scanning periods, the effect of variation in output current characteristics of the current conversion circuits DAC1 to DACn is dispersed between the pixel groups in each of the columns, thereby reducing a linear-shaped uneven display appearing in columns. Furthermore, since correspondence relationships are changed at the first and second selector circuits 10 and 20 in each of the field scanning periods, respectively, a pattern still remaining even by changing in each of the horizontal scanning periods is normalized so that an uneven display is hardly recognized.

Furthermore, the variation in the output current characteristics of the current conversion circuits DAC1 to DACn occurs randomly, so that it is preferable that changing an input pattern and an output pattern of the first and second selector circuits 10 and 20 is set arbitrarily according to the input/output pattern selection signal SEL. This can reduce the uneven display in the display devices and provide an optimal display.

What is claimed is:

1. A drive system of a display device, comprising:

a plurality of pixels provided in a matrix form comprising rows and columns, the pixels having corresponding current drive elements therein;

a plurality of current conversion circuits converting digital display signals that the drive system receives into analog currents corresponding to the digital display signals, the number of the current conversion circuits being equal to the number of the columns;

a first selector circuit supplying the digital display signals to the respective current conversion circuits; and a second selector circuit receiving outputs of the current conversion circuits and supplying the outputs to the respective pixels, wherein the first and second selector circuits are configured such that during one field period one of the current conversion circuits supplies an output thereof to a pixel element corresponding to one of the columns in a horizontal scanning of said one field period and supplies the output thereof to a pixel element corresponding to another of the columns in another horizontal scanning of said one field period subsequent to the horizontal scanning.

2. The drive system of a display device of claim 1, wherein one of the pixels receives an output from a current conversion circuit during said one field period and receives an output from another of the current conversion circuits during another field period.

3. The drive system of a display device of claim 1, wherein said one of the current conversion circuits that supplies the output to the pixel element is chosen arbitrarily in response to an input/output pattern selection signal.

4. The drive system of a display device of claim 1, wherein each of the current drive elements comprises an organic electroluminescent element.

5. The drive system of a display device of claim 2, wherein each of the current drive elements comprises an organic electroluminescent element.

6. The drive system of a display device of claim 3, wherein each of the current drive elements comprises an organic electroluminescent element.

7. A drive system of a display device, comprising;

a plurality of pixels provided in a matrix form comprising rows and columns, the pixels having corresponding current drive elements therein;

a current conversion circuit converting a digital display signal that the drive system receives into an analog current corresponding to the digital display signal, the current conversion circuit being provided for each of the columns;

a first selector circuit receiving digital display signals that are directed to corresponding columns and routing the received digital display signals to current conversion circuits corresponding to columns that are not the destinations of the digital display signals; and a second selector circuit receiving the analog currents of the current conversion circuits and rerouting the analog currents to the columns that are the destinations of the digital display signals.

8. The drive system of a display device of claim 7, wherein each of the current conversion circuits is configured to supply the analog current to a pixel corresponding to a column in a horizontal scanning and supply the analog current to another pixel corresponding to another column in another horizontal scanning.

9. The drive system of the display device of claim 7, wherein each of the current drive elements comprises an organic electroluminescent element.

10. The drive system of the display device of claim 8, wherein each of the current drive elements comprises an organic electroluminescent element.

* * * * *